US009296590B2

(12) United States Patent
Kocher et al.

(10) Patent No.: US 9,296,590 B2
(45) Date of Patent: Mar. 29, 2016

(54) SAFETY DEVICE FOR BRAKING AN ELEVATOR CAGE

(71) Applicant: Inventio AG, Hergiswil NW (CH)

(72) Inventors: Hans Kocher, Udligenswil (CH); Astrid Sonnenmoser, Ebikon (CH); Jean-Philippe Escher, Thalwil (CH)

(73) Assignee: Inventio AG, Hergiswil (CH)

( * ) Notice: Subject to any disclaimer, the term of this patent is extended or adjusted under 35 U.S.C. 154(b) by 636 days.

(21) Appl. No.: 13/721,942

(22) Filed: Dec. 20, 2012

(65) Prior Publication Data

US 2013/0161131 A1 Jun. 27, 2013

(30) Foreign Application Priority Data

Dec. 23, 2011 (EP) ..... 11195470

(51) Int. Cl.

| | |
|---|---|
| ***B66B 9/00*** | (2006.01) |
| ***B66B 1/24*** | (2006.01) |
| ***B66B 1/32*** | (2006.01) |
| ***B66B 1/30*** | (2006.01) |
| ***B66B 5/02*** | (2006.01) |
| ***B66B 5/06*** | (2006.01) |

(52) U.S. Cl.

CPC ... *B66B 1/24* (2013.01); *B66B 1/30* (2013.01); *B66B 1/32* (2013.01); *B66B 5/02* (2013.01); *B66B 5/06* (2013.01)

(58) Field of Classification Search

CPC ..... B66B 1/24; B66B 1/30; B66B 1/32; B66B 5/02; B66B 5/06

USPC ..... 187/247, 249, 391, 393

See application file for complete search history.

(56) References Cited

U.S. PATENT DOCUMENTS

| | | | | |
|---|---|---|---|---|
| 5,663,538 | A * | 9/1997 | Sakita | 187/382 |
| 5,877,462 | A * | 3/1999 | Chenais | 187/249 |
| 7,353,912 | B2 * | 4/2008 | Reuter et al. | 187/249 |
| 7,448,471 | B2 * | 11/2008 | Nuebling | 187/286 |
| 7,650,966 | B2 * | 1/2010 | Sansevero et al. | 187/249 |
| 8,136,635 | B2 * | 3/2012 | Christy et al. | 187/249 |
| 8,424,651 | B2 * | 4/2013 | Brand | 187/249 |
| 8,434,599 | B2 * | 5/2013 | Wang et al. | 187/249 |
| 8,739,936 | B2 * | 6/2014 | Kostka et al. | 187/249 |
| 9,010,499 | B2 * | 4/2015 | McCarthy et al. | 187/393 |
| 2011/0259674 | A1 * | 10/2011 | Silberhorn et al. | 187/247 |
| 2012/0152656 | A1 * | 6/2012 | Kocher | B66B 5/0031 187/247 |

FOREIGN PATENT DOCUMENTS

| | | | |
|---|---|---|---|
| EP | 1562848 | A1 | 8/2005 |
| EP | 1698580 | A1 | 9/2006 |
| WO | 2004043842 | A1 | 5/2004 |

* cited by examiner

*Primary Examiner* — Anthony Salata

(74) *Attorney, Agent, or Firm* — Fraser Clemens Martin & Miller LLC; William J. Clemens

(57) ABSTRACT

An elevator has a first and a second cage, which are movable along a common travel path. In addition, the elevator includes a safety device, by which the two cages can be monitored, and a shaft information system, which is connected with the safety device and by which the speed and the position of the two cages can be determined. If the two cages fall below a safety spacing, a first braking measure can be initiated for at least a first cage by means of the safety device. A retardation plot for the at least first cage is predeterminable by the safety device on initiation of the first braking measure. In that case, a second braking measure can be initiated for the at least first cage by means of the safety device if the retardation plot is exceeded.

14 Claims, 3 Drawing Sheets

| | |
|---|---|
| 21 | SUSPENSION POINT |
| 22, 32 | SAFETY DEVICE |
| 25, 36 | DISTANCE SENSOR |
| 23.1, 23.2, 33.1, 33.2 | CAGE BRAKES |

SAFETY DEVICE FOR BRAKING AN ELEVATOR CAGE

CROSS-REFERENCE TO RELATED APPLICATION

This application claims priority to European Patent Application No. 11195470.7, filed Dec. 23, 2011, which is incorporated herein by reference.

FIELD

The present disclosure relates to an elevator with two independently movable cages.

BACKGROUND

The problem of collision avoidance is often present in the case of operation of elevators with at least two cages movable along a common travel path.

A safety device is proposed in European Patent Specification 1 562 848 A1, which takes account of the above-mentioned problem. This safety device prevents a collision between two cages in that the safety device monitors whether the cages maintain a critical safety spacing. If this critical safety spacing is fallen below, the safety device initiates an emergency stop. The safety device additionally monitors the spacing between the two cages during execution of the emergency stop. If notwithstanding the emergency stop a further approach of the cages takes place and in that case a minimum safety spacing is fallen below, then the safety device initiates safety braking.

The above safety device was further refined in European Patent Specification 1 698 580 A1. Here, too, the safety device continuously monitors a critical safety spacing and in a given case a minimum safety spacing and if the respective safety spacing is fallen below appropriately initiates an emergency stop or a safety braking. These safety spacings are, however, determinable on the basis of a predeterminable emergency stop trigger plot and a predeterminable safety brake trigger plot. This can mean that a respective speed-dependent critical or minimum safety spacing is determinable for the instantaneous travel speed of a cage. Correspondingly, the cages can in the case of a lower travel speed approach to a further extent without a braking measure being initiated. This makes possible, in particular, approach of the cages to two adjacent stories.

However, in the case of the two above-mentioned two-stage braking procedures the spacing of the two elevator cages is usually continuously monitored and compared with a critical and a minimum safety spacing. This continuous monitoring of the spacing can impose relatively high demands on the computing capacity of the safety device. This applies particularly in the case of calculation, in dependence on trigger plot, of the safety spacings of the two braking procedures.

SUMMARY

At least some embodiments comprise an elevator with a safety device which prevents collision between the cages in simple and reliable manner.

The elevator comprises a first and a second cage, which are movable along a common travel path, a safety device, by which the two cages can be monitored, and a shaft information system, which is connected with the safety device and by which the speed and position of the two cages are determinable. In that case, a first braking measure can be initiated for at least one first cage by means of the safety device if the two cages fall below a safety spacing. A retardation plot for the at least first cage is predeterminable by means of the safety device on initiation of the first braking measure. A second braking measure can be initiated by means of the safety device if the at least first cage exceeds the retardation plot.

A possible advantage of this elevator resides in the fact that after initiation of the first braking measure the safety device predetermines a retardation plot for the first cage. As a consequence, the spacing between the first cage and the second cage no longer has to be monitored. During the retardation the safety device merely compares the speed of the first cage with the predetermined speed value of the retardation plot per braking travel covered. This simple value comparison imposes relatively small demands on the computing capacity of the safety device.

In some embodiments, the retardation plot is calculated—directly on initiation of the first braking measure—by a program, which can be executed in a processor of the safety device, and is predeterminable for the at least first cage.

BRIEF DESCRIPTION OF THE DRAWINGS

The disclosed technologies are further described in the following by embodiments and figures, in which.

DETAILED DESCRIPTION

Figure 1:
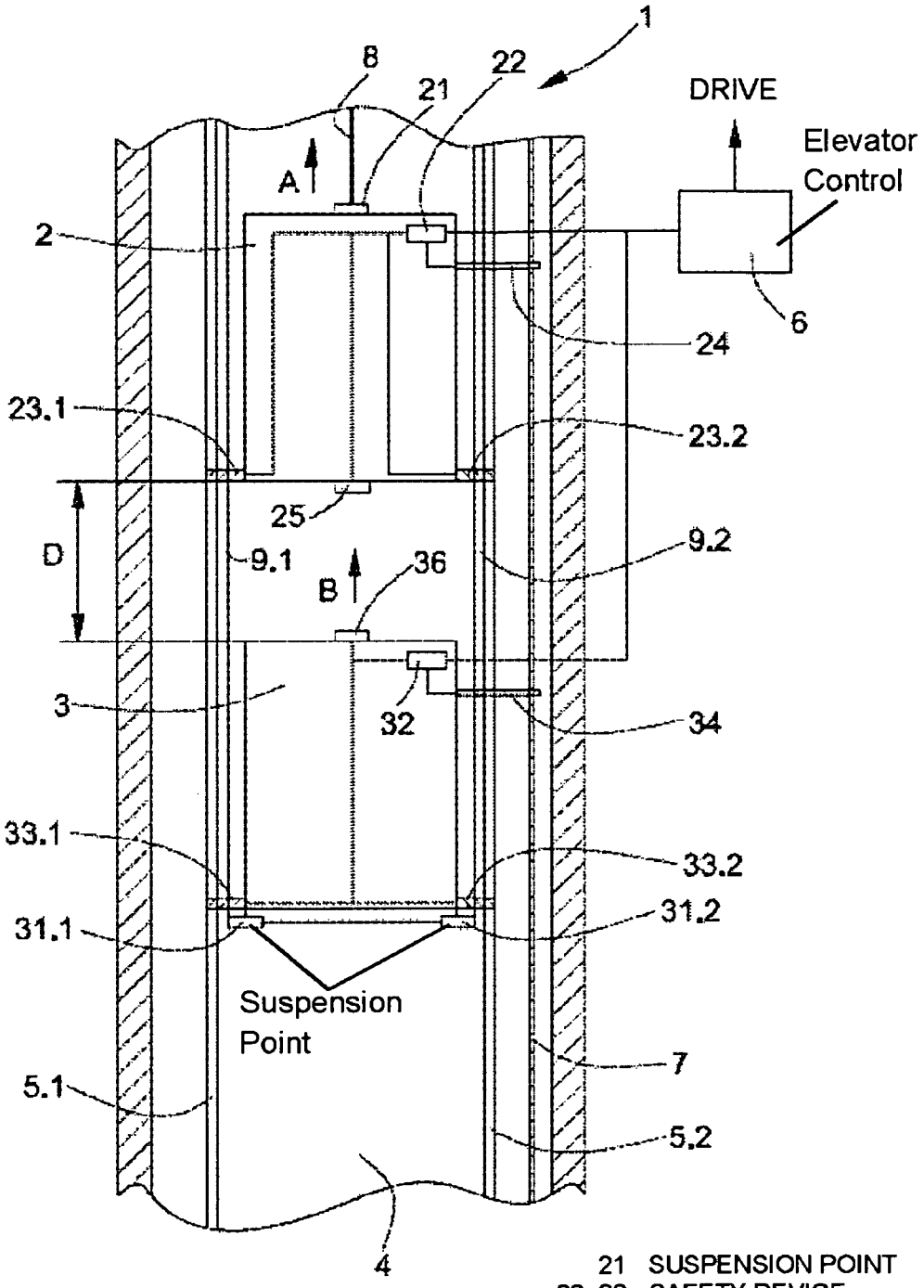
FIG. 1 shows an elevator with a safety device for preventing a collision between two cages independently movable along a common travel path.

FIG. 1 shows an elevator 1 with at least two cages 2, 3. Each of these cages 2, 3 is independently movable substantially along a common travel path. In the illustrated example the travel path is defined by a pair of cage guide rails 5.1, 5.2 installed in an elevator shaft 4.

The cages 2, 3 are respectively suspended at a support means 8, 9.1, 9.2. In that case the suspension ratio of 1:1 illustrated here represents a common suspension ratio in elevator construction. However, a higher suspension ratio 2:1, 3:1 or more differing therefrom can also be selected.

The upper cage 2 is suspended at a first suspension point 21 at a first support means 8. The suspension point 21 possibly lies centrally on the upper side of the upper cage 2. From the first suspension point 21 the support means runs upwardly into the upper region of the elevator shaft 4. There the first support means 8 runs over a first drive pulley. The first support means 8 is guided downwardly again by means of the drive pulley and optional first deflecting rollers to a first counterweight. The first counterweight is similarly suspended at the first support means 8 and balances out the weight force of the upper cage 2.

A lower cage 3 is fastened at second and third suspension points 31.1, 31.2 to a second support means, which comprises two second support means runs 9.1, 9.2. The lower cage 3 is possibly suspended in its lower region on opposite sides at the two support means runs 9.1, 9.2. From the second and third suspension points 31.1, 31.2 the support means runs 9.1, 9.2 run laterally past the upper cage 2 upwardly into the upper region of the elevator shaft 4. There the second support means runs 9.1, 9.2 run over second drive pulleys. The second support means runs 9.1, 9.2 are led downwardly again by means of the second drive pulleys and optional second deflecting pulleys to a second counterweight. The second counterweight is finally similarly suspended at the second support means runs 9.1, 9.2 and balances out the weight force of the lower elevator cage 3.

The first and second drive pulleys are respectively driven by a first drive and second drive. The first and second drives transmit, by means of the respectively associated drive pulleys, a driving momentum to the first and second support means 8, 9.1, 9.2. Correspondingly, the two cages (2, 3) are movable largely independently of one another by an associated drive. For that purpose the first and second drives each comprise an associated motor and an associated drive brake.

In addition, an elevator control 6 which controls the two drives of the cages 2, 3 is provided. A passenger calls an elevator cage 2, 3 to a story by means of call input apparatus, which are respectively arranged at a story and connected with the elevator control 6. These call input apparatus are possibly designed as destination call input apparatus. On operation of such a destination call apparatus there is not only indicated to a passenger his or her location at a story at which he or she waits for a cage 2, 3, but also the elevator control 6 communicates his or her desired destination story. The elevator control 6 allocates a suitable cage 2, 3 to this call and moves the allocated cage 2, 3 to the story and ultimately to the destination story. For that purpose the elevator control 6 controls the motor and the drive brake of the drive associated with the allocated cage 2, 3.

In addition, the elevator 1 comprises a shaft information system. This shaft information system comprises, for example, a code strip 7 with code marks and, per cage 2, 3, a sensor 24, 34 for reading the code marks. The code strip 7 is mounted along the travel path in the elevator shaft 4. The code marks possibly represent a unique non-confusable item of position information. Speed data can be generated by means of evaluation of the positional data over time. The shaft information system thus makes available for each cage 2, 3 at least data about the position and speed thereof to the elevator control 6 and the safety device 22, 32. The safety device 22, 32 evaluates the positional data and/or speed data arriving from the sensors 24, 34. This also includes calculation of the spacing between the cages 2, 3 from the positional data thereof.

The shaft information system optionally comprises a distance sensor 25 arranged at the upper cage 2. The spacing from the lower cage 3 can be ascertained by means of this distance sensor 25. The lower cage 3 can similarly be equipped with a distance sensor 36 by which the spacing from the adjacent upper cage 2 can be ascertained. The distance sensors 25, 36 are respectively connected with the safety device 22, 32. The safety device 22, 32 evaluates the spacing data arriving from the distance sensors 25, 36. A distance sensor 25, 36 is, for example, designed as a laser distance measuring sensor or as an ultrasonic distance measuring sensor.

In addition, the safety device 22, 32 can check the arriving spacing data of the respective distance sensors 25, 36 for equality. In this plausibility test the safety device 22, 32 ascertains whether the distance sensors 25, 36 function reliably. If the spacing data of the distance sensors 25, 36 does not correspond, the safety device 22, 32 has resort to expedient measures in order to bring the elevator 1 to a safe state. Thus, the safety device 22, 32 can, for example, stop the elevator 1, since in the case of faulty evaluation of the spacing data it is no longer possible to exclude a collision between the cages 2, 3. The spacing data of the distance sensors 25, 36 can also be compared in a plausibility test with the spacing calculated by the shaft information system from the positional statements of the cages 2, 3.

In the illustrated example a decentrally operating safety device 22, 32 is associated with each cage 2, 3 and respectively connected with the cage brake 23.1, 23.2, 33.1, 33.2, which is associated with a cage 2, 3, as well as the sensors 24, 34. The sensors 24, 34 communicate positional and speed data to the safety device 22, 32. The cage brakes 23.1, 23.2, 33.1, 33.2 are controllable by the safety device 22, 32. In addition, the safety device 22, 32 communicates with the elevator control 6 and by way of this indirectly controls the first and second drives as well as the associated drive brakes and motors thereof. A respective safety device 22, 32 also has available, by way of the elevator control unit 6, data with respect to the position and the speed of the respective other cage 3, 2. Alternatively, the safety device 22, 32 of a cage 2, 3 is directly connected with the respective drive and the associated drive brakes thereof and can in a given case directly control the drive or the drive brakes or motors. In departure from the configuration with two safety devices 22, 32, which are each associated with a respective cage 2, 3, it is also possible to use a central safety device which monitors the two cages 2, 3 and which controls the drives and cage brakes 23.1, 23.2, 33.1, 33.2. A direct information exchange with respect to position and speed of the respective other cage 2, 3 is equally possible between the two safety devices 22, 32.

In addition, the safety device 22, 23 of a cage 2, 3 is connected with a cage brake 23.1, 23.2, 33.1, 33.2 associated with the respective cage 2, 3 and can control this in the case of a risk-laden approach of the two cages 2, 3.

The example shown in FIG. 1 represents a snapshot in which the upper cage 2 moves in front in a direction A and a lower cage 3 moves behind the upper cage 2 in the same direction B.

The safety device 32 of the lower, trailing cage 3 compares the instantaneous spacing with a permissible safety spacing D. For that purpose, the safety device 32 comprises at least a processor and a memory unit, wherein a program for comparison of an instantaneous spacing with the safety spacing D is filed in the memory unit and the processor calls up this program and implements the comparison. This program compares spacing data, which are provided by the shaft information system, with a safety spacing D. This safety spacing D is filed in the memory unit either as a fixedly predetermined value or as a further program which enables speed-dependent computation of the safety spacing D.

The permissible safety spacing D represents a spacing at which safe braking of the trailing, lower cage 3 is just still possible. If this permissible safety spacing is fallen below, then the safety device 32 initiates a first braking measure in order to prevent a collision between the two cages 2 and 3. For that purpose, the safety device 32 controls the drive of the trailing, lower cage 3 so as to brake the lower cage 3. The first braking measure is possibly carried out by means of actuation of a drive brake associated with the drive. Alternatively or additionally the first braking measure is performable by a motor, which is associated with the drive, by means of application of a torque opposite to the rotational movement of an associated drive pulley.

On initiation of the first braking measure the safety device 32 of the trailing, lower cage 3 predetermines a retardation plot. In a first variant of embodiment this retardation plot is fixedly filed in the memory unit. In this regard, the retardation plot is possibly oriented towards the rated speed which a cage 2, 3 achieves in normal operation of the elevator 1. In a second variant of embodiment the retardation plot can be calculated in dependence on speed by means of a further program filed in the memory unit. For that purpose, the processor calls up this program and performs the corresponding computation.

During the first braking measure the safety device 22, 32 compares the instantaneous speed—per brake travel covered—of the trailing, lower cage 3 with the speed value predetermined by the retardation plot. A further program, which the processor calls up and executes, is for this comparison filed in the memory unit. If this retardation plot cannot be maintained by means of the first braking measure, i.e. if a speed associated with an achieved brake travel is exceeded, the safety device 32 initiates a second braking measure.

In this second braking measure the safety device 32 controls the cage brake 33.1, 33.2 which is associated with the trailing, lower cage 3 and which brakes the lower cage 3.

In the case of two cages 2, 3 travelling in the same direction possibly only the trailing, lower cage 3 is braked by the first braking measure or second braking measure. The leading, first, upper cage 2 can continue the travel and in that case softens the risk-laden approach of the two cages 2, 3. The above statements are correspondingly applicable to a leading, lower cage 3 and a trailing, upper cage 2. In this regard, in the case of a risk-laden approach between the two cages 2, 3 merely the trailing, upper cage 2 is braked by means of a first or second braking measure.

Further embodiments can be used in exactly the same way on cages 2, 3 of mutually opposite travel direction, wherein the lower cage 3 as shown in FIG. 1 travels in a direction B and the upper cage 2 moves in a direction, which is opposite the direction A, towards the lower cage 3. In the case of two cages 2, 3 moving towards one another the safety spacing D is doubled to 2*D. If this safety spacing 2*D is fallen below, the safety device 22, 32 controls the two drives or drive brakes or motors in order to initiate a first braking measure. In that case, both cages 2, 3 are braked. Here, too, the safety spacing 2*D can be ascertained by the safety device 22, 32 in dependence on speed. The faster a cage 2, 3 is moved, the greater the safety spacing D is ascertained to be.

On initiation of the first braking measure for the upper and lower cages 2, 3, the safety device 22, 32 predetermines a retardation plot for each cage 2, 3. If one of the two cages 2, 3 or even both cages 2, 3 cannot maintain this retardation plot or exceeds or exceed a speed for a predetermined achieved brake travel, then the safety device 22, 32 initiates a second braking measure for the cage 2, 3 concerned. For that purpose the safety device 22, 32 controls the cage brake 23.1, 23.2, 33.1, 33.2 of the respective cage 2, 3 in order to brake the cage 2, 3. In the case of opposite travel directions A, B of the two cages 2, 3 a respective first or in a given case second braking measure can thus be initiated by means of the safety device 22, 32 for the first and second cage 2, 3.

Figure 2:
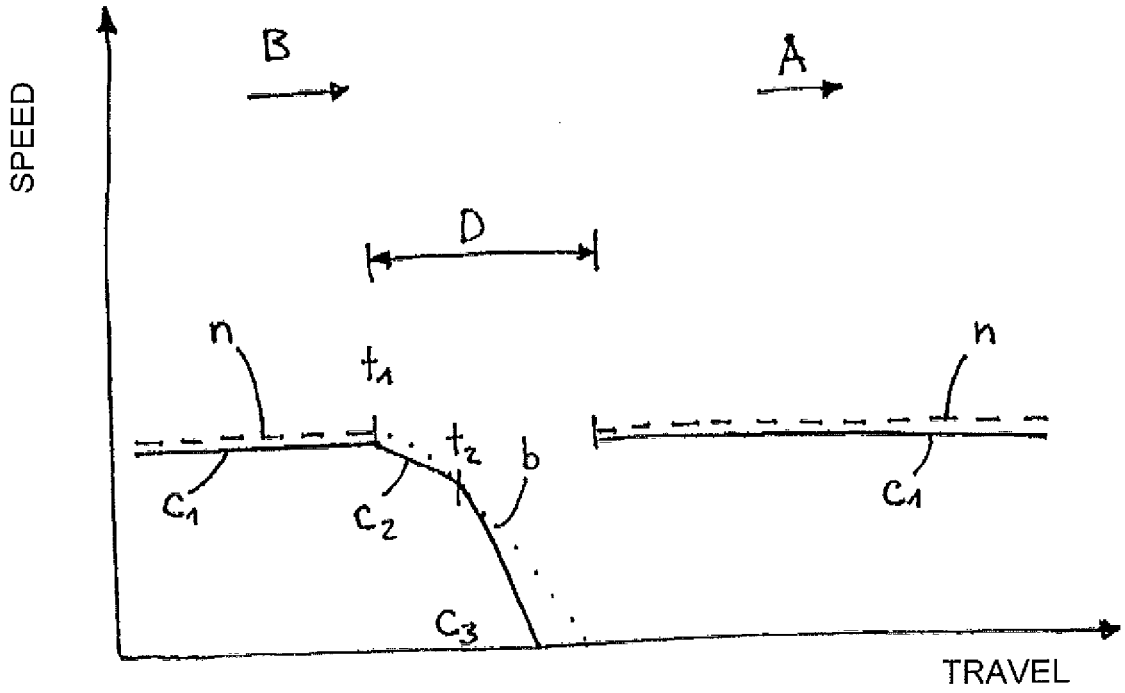
FIG. 2 shows travel/speed plots of two cages, which are moving one behind the other, on intervention of the safety device.
Figure 3:
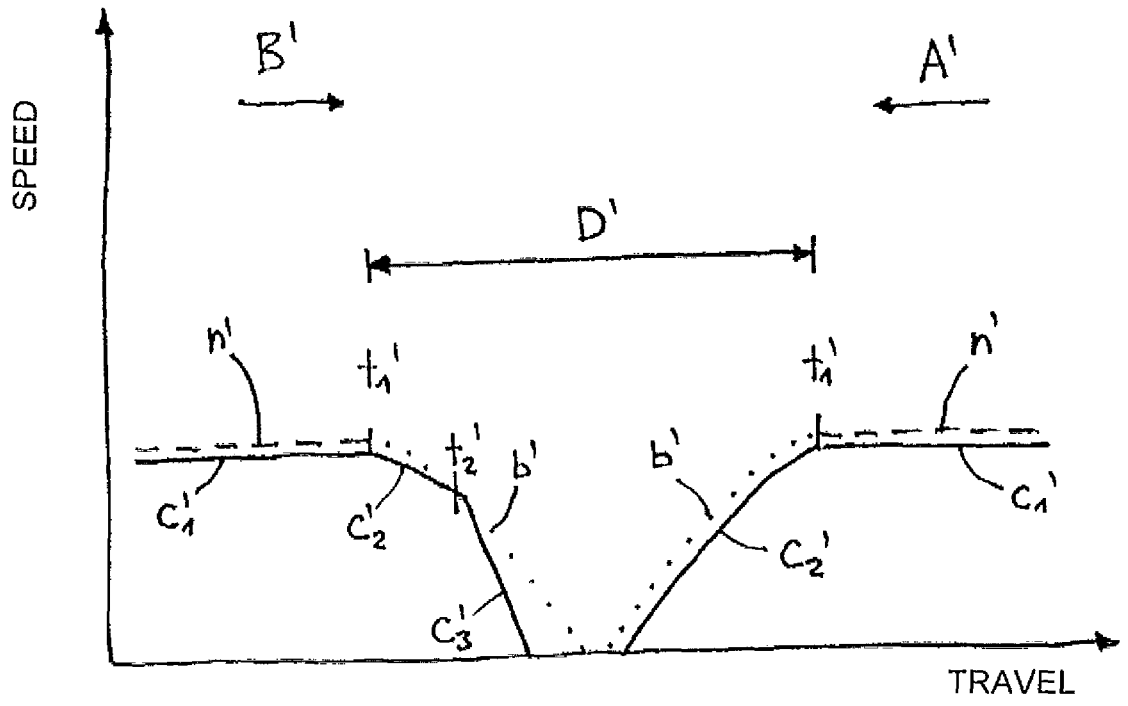
FIG. 3 shows travel/speed plots of two cages, which are moving towards one another, on intervention of the safety device.

Two braking examples on the basis of a travel/speed plot of the two cages 2, 3 are illustrated in FIGS. 2 and 3.

FIG. 2 shows a situation corresponding with that of FIG. 1. The two cages 2, 3 are moved in the same travel direction A, B. A first, leading cage 2 is moved in travel direction A and a second, trailing cage 3 is moved in travel direction B. The trailing cage 3 is moved, before a time instant t1, at a first speed c1 lying below the rated speed n. The leading cage 2, thereagainst, is moved, before a time instant t1, at a speed which is lower than c1. This is the case, for example, after a stop at a story during approach of the leading cage 2. The travel of the leading cage 2 before the time instant t1 is, for the sake of clarity, not illustrated in FIG. 2. At the time instant t1 the safety spacing D between the leading and trailing cages 3, 4 is fallen below. The safety device 32 accordingly initiates a first braking measure. At the same time the safety device 32 predetermines a retardation plot b. After initiation of the first braking measure the trailing cage 3 is braked in correspondence with the retardation plot c2. At the time instant t2, the speed of the trailing cage 3 lies above the predetermined retardation plot b. This causes the safety device 32 to initiate a second braking measure for the trailing cage 3. After initiation of the second braking measure the trailing cage 3 is braked in correspondence with the retardation plot c3 until at standstill. During this two-stage braking process of the trailing cage 3 the leading cage 2 can continue to travel at the speed c1.

FIG. 3, thereagainst, shows a situation in which the two cages 2, 3 travel towards one another. The two cages 2, 3 are moved in correspondence with the travel directions A', B'. An upper cage 2 is moved in travel direction A' and a lower cage 3 is moved in opposite travel direction 13'. The two cages 2, 3 are moved, before a time instant t1', at a speed c1' lying below the rated speed n'. At the time instant t1' the safety spacing D' between the first and second cages 2, 3 is fallen below, wherein the safety spacing D'=2D. Accordingly, the safety device 22, 32 initiates a first braking measure for both cages 2, 3. At the same time the safety device 22, 32 predetermines a retardation plot b' for each of the two cages 2, 3. After initiation of the first braking measure the first and second cages 2, 3 are braked in correspondence with the retardation plot c2'. At the time instant t2' the speed of the lower cage 3 lies above the predetermined retardation plot b'. This causes the safety device 32 to initiate a second braking measure for the lower cage 3. After initiation of the second braking measure the lower cage 3 is braked to a standstill in correspondence with the retardation plot c3'. By contrast, the upper cage 2 remains, after initiation of the first braking measure and until attainment of standstill, always below the predetermined retardation plot b'. A second braking measure is not necessary for the upper cage 2.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator, comprising:

a first cage;

a second cage, the first and second cages being movable along a common travel path;

a shaft information system for determining speed and position information for the first and second cages; and a safety device for monitoring the first and second cages, the safety device being connected to the shaft information system and being configured to, initiate a first braking measure for at least the first cage when a distance between the first and second cages falls below a safety spacing, predetermine a retardation plot for at least the first cage, and initiate a second braking measure for at least the first cage as a result of the retardation plot being exceeded.

2. The elevator of claim 1, the first cage comprising a first drive and the second cage comprising a second drive, the first drive and the second drive being controllable by the safety device to initiate the first braking measure.

3. The elevator of claim 2, the first drive comprising a first holding brake and the second drive comprising a second holding brake, the first and second holding brakes being controllable by the safety device.

4. The elevator of claim 1, the first cage comprising a first cage brake and the second cage comprising a second cage brake, the first and second cage brakes being controllable by the safety device to initiate the second braking measure.

5. The elevator of claim 1, the first cage comprising a distance sensor for determining the distance between the first and second cages.

6. The elevator of claim 1, the safety device being configured to initiate the first and second braking measures for only the first cage when the first and second cages travel in a common direction along the common travel path and the first cage is a trailing cage.

7. The elevator of claim 1, the safety device being configured to initiate the first braking measure or the second braking measure for the first and second cages when the first and second cages travel in opposite directions along the common travel path.

8. The elevator of claim 1, the safety spacing being dependent on speed or travel direction of the first and second cages.

9. The elevator of claim 1, the retardation plot being dependent on a speed of the first cage.

10. The elevator of claim 1, the safety device being configured to predetermine the retardation plot by a program executed by a processor of the safety device upon the initiation of the first braking measure.

11. The elevator of claim 1, the safety device being configured to initiate the second braking measure after the initiation of the first braking measure and on the basis of a comparison of a speed of at least the first cage with a speed value of the retardation plot per brake travel covered.

12. The elevator of claim 11, the safety device being configured to initiate the second braking measure only on the basis of a comparison of the speed of at least the first cage with the speed value of the retardation plot per brake travel covered.

13. The elevator of claim 11, the safety device being configured to initiate the second braking measure independent of the distances between the first and second cages.

14. An elevator, comprising:

a first cage;

a second cage, the first and second cages being movable along a common travel path;

a shaft information system for determining speed and position information for the first and second cages; and a safety device for monitoring the first and second cages, the safety device being connected to the shaft information system and being configured to, initiate a first braking measure for at least the first cage when a distance between the first and second cages falls below a safety spacing, predetermine a retardation plot for at least the first cage, the retardation plot being one of stored in a memory and calculated in dependence on the speed information, and initiate a second braking measure for at least the first cage as a result of the retardation plot being exceeded.

* * * * *